73-152 SR
8/26/86 OR 4,607,524

United States Patent [19]
Gringarten

[11] Patent Number: 4,607,524
[45] Date of Patent: Aug. 26, 1986

[54] METHOD FOR OBTAINING A DIMENSIONLESS REPRESENTATION OF WELL PRESSURE DATA WITHOUT THE USE OF TYPE-CURVES

[75] Inventor: Alain C. Gringarten, Englewood, Colo.

[73] Assignee: Scientific Software-Intercomp, Inc., Denver, Colo.

[21] Appl. No.: 721,197

[22] Filed: Apr. 9, 1985

[51] Int. Cl.[4] ..... E21B 49/00
[52] U.S. Cl. ..... 73/152
[58] Field of Search ..... 73/155, 152

[56] References Cited

U.S. PATENT DOCUMENTS 3,636,762 1/1972 Kuo et al. ..... 73/155
4,328,705 5/1982 Gringarten ..... 73/155

OTHER PUBLICATIONS

Buck, Pressure Build-Up Curves Show Oil-In-Place, May 1955, The Petroleum Engineer.
"A New Set of Type Curves Simplifies Well Test Analysis" by D. Bourdet, T. M. Whittle, A. A. Douglas and Y. M. Pirard, published by *World Oil*, May 1983.

*Primary Examiner*—Stewart J. Levy
*Assistant Examiner*—Robert R. Raevis
*Attorney, Agent, or Firm*—Sheridan, Ross & McIntosh

[57] ABSTRACT

A method for determining desired physical characteristics of an underground formation is provided. The present invention is characterized by a determination of dimensionless pressure parameters without resort to a series of type-curves. The method includes finding a pressure match that relates a dimensionless function of pressure with experimental pressure data and finding a time match that relates a dimensionless function of time with dimensioned time. In one embodiment, this determination is made using a pressure derivative curve plotted on a computer terminal display screen. An interactive graphics software package is utilized in which the user selects certain values associated with the experimental data for which corresponding dimensionless values are known. From the determined values of pressure match and time match, a dimensionless function of pressure curve and a dimensionless pressure function derivative curve are provided on the display screen. Type-curves represented by dimensionless parameters are also provided. A selection of an appropriate interpretation model is made using the experimental pressure function curve and one of the series of type-curves. From the selection, the user is able to determine the physical characteristics of the underground formation.

14 Claims, 6 Drawing Figures

METHOD FOR OBTAINING A DIMENSIONLESS REPRESENTATION OF WELL PRESSURE DATA WITHOUT THE USE OF TYPE-CURVES

FIELD OF THE INVENTION

The present invention relates to a method for use in determining underground formation parameters and, in particular, to a method for providing dimensionless pressure data as a function of dimensionless time.

BACKGROUND INFORMATION

It is common practice to utilize various techniques for identifying well and reservoir behavior. To identify such behavior, physical characteristics and parameters of the underground formation are found. The particular underground formation of interest is analyzed by obtaining experimental pressure data over time. This experimental pressure data versus time data can be obtained during the build-up of the well as well as during the drawdown of the well. Using a diagnostic plot of the pressure data as a function of time, a subsequent comparison can be made with theoretical type-curves in order to identify the interpretation model by matching the diagnostic plot with one of the type-curves. After the matching of the diagnostic plot with one of such curves, a verification of the match is typically made. That is, usually by another analysis technique, a check is made to determine whether or not a proper match was made. By way of example, the well-known Horner analysis, or some derived form of the Horner technique, is conducted to determine whether a proper selection or match was made and accurate underground characteristics obtained.

In conjunction with matching the experimental diagnostic plot with one of a series of type-curves, it is common practice to define the type-curves using dimensionless pressure versus dimensionless time wherein each curve of the series of type-curves is distinguishable by a dimensionless number that depends upon the specific reservoir model. Each dimensionless parameter can be defined as the measured or experimental parameter, corresponding to the dimensionless parameter, multiplied by a constant coefficient. The coefficient relates to parameters characterizing the reservoir, the fluid, and the test made in conjunction with obtaining the experimental pressure data. Accordingly, before finding the match between the diagnostic plot and one of the type-curves, a conversion is normally made from dimensioned pressure data to dimensionless pressure data using a constant coefficient.

In connection with the determination of the dimensionless parameters, the derivative of the diagnostic plot of pressure versus time is found and also plotted in using the method of the present invention. The pressure derivative curve is used in finding the pressure match and the time match. The pressure match is defined as being equal to the dimensionless pressure divided by the change in pressure or delta pressure ($p_D$/delta (p)). While the time match is defined as being equal to the dimensionless time divided by the change in time or delta time, where the definition of dimensionless time depends upon the type-curves being used, e.g., in the case of wellbore storage, dimensionless time$=t_D/C_D$ and in the case of a fractured well, dimensionless time$=t_{Df}$. Each of the pressure match and time match values is constant for a particular diagnostic plot. Using each of these two determined constant values, corresponding dimensionless pressure and dimensionless time values can be determined using the experimental pressure data.

The differentiation of the pressure data or points making up the pressure curve has been previously advanced in connection with underground formation analysis. A use of the pressure derivative curve is disclosed in an article entitled "A New Set of Type Curves Simplifies Well Test Analysis" authored by D. Bourdet, T. M. Whittle, A. A. Douglas, and Y. M. Pirard and published in *World Oil,* May, 1983. This article discusses, among other things, a method for determining pressure match and time match utilizing the pressure derivative curve. This disclosed method, however, depends upon type-curves to determine the pressure match and the time match. Specifically, the method disclosed in the article involves the obtaining of the pressure and time related data and then determining the derivative of the pressure data with respect to dimensionless time over dimensionless wellbore storage ($t_D/C_D$). Both the pressure and derivative of pressure experimental data are plotted on the same graph. In addition to the pressure and derivative of pressure curves, a graph of a series of type-curves are provided. The type-curves include two sets of curves. A first set relates to a plot of dimensionless pressure ($p_D$) versus dimensionless time ($t_D/C_D$) while the second set relates to a plot of the derivative of dimensionless pressure relative to dimensionless time. To determine the pressure match and time match, both the pressure and the pressure derivative experimental data are matched to corresponding type-curves and pressure derivative type-curves. This matching is accomplished by shifting the dimensionless data graph relative to the dimensioned data graph while keeping the axes of the two graphs parallel. The shifting is continued until a fit or match is obtained for both the pressure and the pressure derivative experimental data. After a match is found, a point (match point) is selected by the user and its coordinates are determined or read from both the dimensionless data graph and the dimensioned data graph. From these four values using the four different axes for the two graphs, pressure match and time match can be found since pressure match$=p_D$/delta (p) and time match$=t_D$/delta (t).

The foregoing method has certain drawbacks. In order to determine the pressure match and time match, a series of type-curves and the diagnostic plot including the pressure derivative curve must be shifted in order to determine pressure match and time match. Such manipulations may prove to be cumbersome and time-consuming to the user of this analysis technique. The present invention seeks to overcome such deficiencies in providing an improved analytical tool for finding pressure match and time match during the process for evaluating underground formation characteristics.

SUMMARY OF THE INVENTION

The present invention provides a method for finding pressure match and time match without using type-curves but instead directly utilizing a pressure derivative curve. The method of the present invention involves recognizing that there is a constant relationship between a plot of experimental or dimensioned pressure versus time and a plot of dimensionless pressure versus dimensionless time. Because of this relationship that depends upon certain characteristics associated with the formation under study, it becomes necessary to determine each constant coefficient or magnitude that relates the dimensioned parameter to a dimensionless parameter. This is accomplished in the present invention by using a plot of the pressure derivative curve displayed on a computer terminal screen and selecting a particular pressure derivative value for which the corresponding dimensionless pressure derivative value is known. Similarly, in one embodiment, a value for dimensioned time is selected using the displayed pressure curve itself for which the corresponding value of dimensionless time is known. Using these selections, the pressure match and time match can be determined. Based on the pressure match and time match magnitudes, dimensionless diagnostic plots of the pressure curve and the derivative of the pressure curve are provided. The dimensionless diagnostic plots are compared with one of a corresponding series of dimensionless type-curves in order to determine certain characteristics associated with the underground formation, including the product permeability-thickness, the wellbore storage, and the skin effect.

More particularly, the present invention relates to the obtaining of experimental or dimensioned pressure data over time from an underground formation. In the case of the well test analysis being based on build-up, a valve is typically closed and the change in pressure of fluid in the well over time is monitored. The monitored data is inputted to a computer for plotting the data on a computer terminal display screen using an interactive graphics software package. The plot utilizes a log-log graph with a pressure data being defined as a function of time. The derivative of the pressure data with respect to some function of time is determined and also plotted on the same display screen. To determine the pressure match, the present method selects a pressure stabilization value or level using the pressure derivative curve. The selected pressure stabilization level is based on the fact that infinite acting radial flow occurs in the underground formation and such flow is usually found at late time pressure data points. The derivative of the pressure curve during that portion in which infinite acting radial flow is represented on the curve always has a dimensionless value of 0.5. The user therefore initiates the drawing of a horizontal straight line by the computer on the display screen through the pressure derivative curve at the point or portion of infinite acting radial flow. A magnitude of the dimensioned pressure corresponding to the dimensionless value of 0.5 is located on the vertical pressure axis intercept with this displayed horizontal line. Since the pressure match equals a constant, which can be defined by a value of dimensionless pressure divided by a corresponding dimensioned pressure, the interactive graphics software determines where the straight line intercepts the ordinate or pressure axis and divides 0.5 by that intercept value. Similarly, to determine the time match, the user of the present inventive method selects that portion of the pressure curve along which the inner boundary effects dominate. This portion of the curve is always represented by the early time data and is identified by a constant slope log-log straight line. In the case of wellbore storage, the slope is a unit slope and the user causes a straight line of unit slope to be drawn on the display screen. The intersection of such a unit slope straight line with the horizontal straight line identifying the pressure stabilization level always has a value equal to 0.5 when wellbore storage exists. The value of this intercept on the dimensioned plot is used with the value of 0.5 to find the time match. That is, the 0.5 value associated with the dimensionless time is divided by the value obtained by the interactive graphics software in determining the intercept of the unit slope straight line and the pressure for radial flow stabilization level. In a case in which there is no wellbore storage but there is an infinite conductivity fracture intersecting the wellbore, the known intercept value is not 0.5 for the dimensionless pressure curves but is 0.25 and the time match corresponds to 0.25 divided by pi (3.1416) divided by the time value found at the intersection of the early time half unit slope log-log straight line with the pressure stabilization level. In another embodiment, instead of using the pressure curve, the pressure derivative curve can be utilized in determining time match, however, the intercept point has a different value depending upon the formation characteristics.

Based on the determined magnitudes for pressure match and time match, the dimensioned pressure and pressure derivative points defining curves can be converted to curves having dimensionless parameters. This is also accomplished by the software and the curves having the dimensionless parameters are then displayed on the display screen. In addition, the type-curves are also displayed. To find the interpretation model for the diagnostic plot or experimental data, that type-curve is selected which passes through the experimental data. Once the type-curve has been selected as passing through the experimental data, it can be checked or verified by conventional techniques such as by the Horner analysis or a derived form thereof.

In view of the foregoing description, a number of salient features associated with the present invention are readily discerned. The method of the present invention enables the user to determine pressure match and time match without resort to type-curves. The present method relies on the pressure derivative curve and the fact that at certain portions of the curve, the same values always exist in a homogeneous or heterogeneous formation. With this information, one of a number of readily available interactive graphics software packages can be employed by the user in finding values corresponding to the known dimensionless values. Because the user need not shift a graph of experimental or dimensioned data relative to a graph with dimensionless parameters, the determination of pressure match and time match is made easier and is made in a less cumbersome fashion. Relatedly, the ultimate objective of matching the actual or experimental pressure data with the theoretical type-curves can be accomplished more rapidly.

Additional advantages of the present invention will become more readily apparent from the following discussion when taken in conjunction with the accompanying drawings.

DETAILED DESCRIPTION OF THE PREFERRED EMBODIMENT

In accordance with the present invention, physical characteristics of a producing zone associated with an underground formation and a borehole formed in the formation are determined. This determination is made to help to define the fluid-producing conditions of the well and the adjacent reservoir, and to reach some conclusion regarding the appropriate treatment to be given the well for enhancing its production capacity. To make such determinations, measurements are made of pressure variations of the fluid in the wellbore versus time. By closing the well, the "build-up" of pressure is obtained by recording the pressure variations beneath the closure location of the well. Conversely, by opening the well, the "drawdown" pressure can be recorded. To shut in or open the wellbore, a valve is normally used and conventional valves are available for this purpose. The experimental pressure data logged over time is used in determining the physical characteristics of the well. In the preferred embodiment, the measured or logged data is provided to a computer for the desired analysis. Specifically, the experimental pressure data obtained as a function of time is stored in computer memory. The computer is programmed using software designed to carry out the necessary analytical steps. The software includes a software interactive graphics package for providing desired displays relating to the experimental pressure data on a computer terminal display screen, which is linked to the computer. The software also includes the necessary processing instructions for carrying out the steps of the present invention. User participation occurs using a keyboard and a cursor associated with the computer as the user is guided by appropriate information that is displayed on the display screen.

Figure 1:
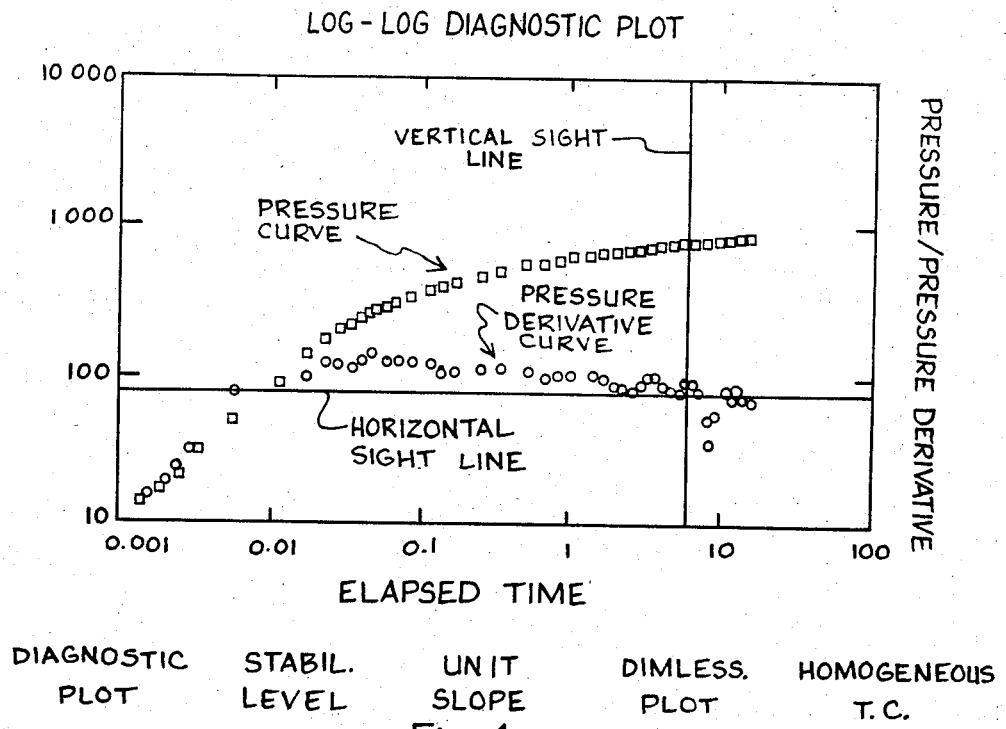
FIG. 1 illustrates a graph of the pressure and pressure derivative curves just prior to the selection by the user of the pressure stabilization level on the pressure derivative curve.
Figure 2:
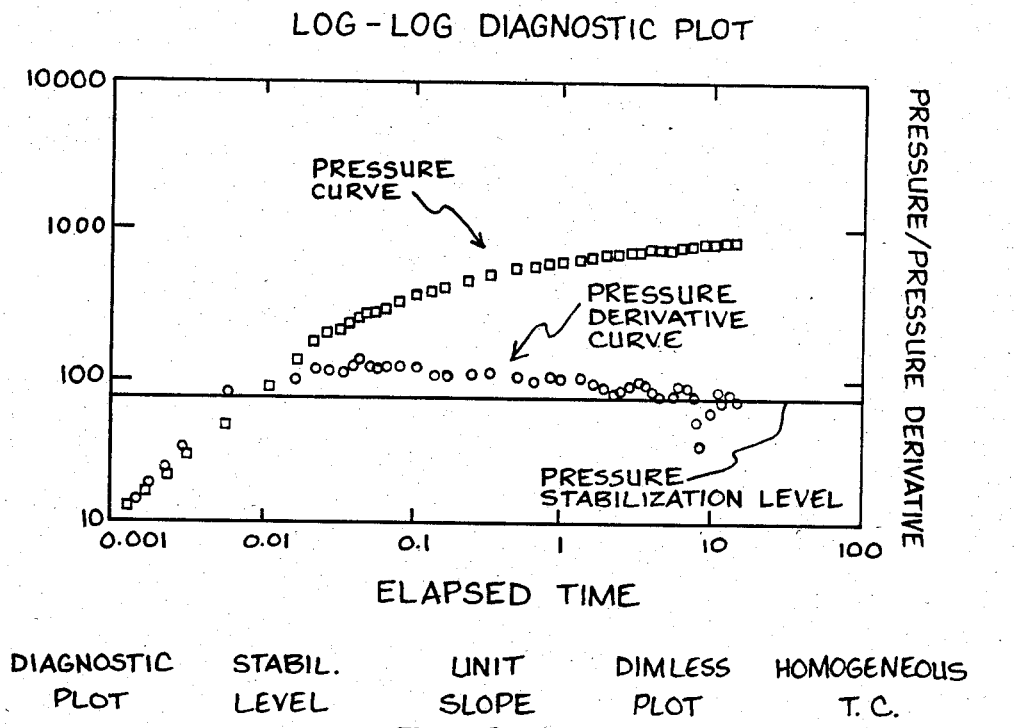
FIG. 2 illustrates a graph with a horizontal straight line drawn through the pressure stabilization level.

With reference to FIG. 1, utilizing the interactive graphics software, the user is able to initiate the display of a log-log graph with a menu of key words that identify routines or procedures that can be accessed by the user during the analysis. With respect to the embodiment illustrated in FIG. 1, the ordinate of the log-log graph relates to pressure change while the abscissa of the log-log graph relates to elapsed time. To call up and display the experimental pressure data as a function of elapsed time, the user employs or activates the cursor to control the positioning of crossing vertical and horizontal sight lines to initiate the display of the diagnostic plot of experimental pressure data as a function of time. In addition, the enabling of the diagnostic plot feature also displays the derivative of the pressure as a function of elapsed time. The various points making up the pressure derivative curve are previously determined by the software which includes an algorithm for finding the pressure derivative points based on the experimental pressure data. After the pressure and pressure derivative curves are plotted or displayed on the computer terminal screen, the user is able to continue with the steps that are to be taken in finding a model or a theoretical curve that corresponds to the actual or experimental pressure data. Using the cursor again, the user next selects or triggers the key identified as "Stabil. Level" displayed on the computer terminal display screen. After this key is enabled, the horizontal and vertical sight lines are moved by the user's movement of the cursor to a position along the pressure derivative curve selected by the user until, as illustrated in FIG. 2, the crossing point of the horizontal and vertical sight lines identifies the point on the pressure derivative curve which the user has selected as best defining the pressure stabilization level.

A pressure stabilization level is selected on the pressure derivative curve because the magnitude of the dimensionless pressure stabilization level on this curve is known to always have a value of 0.5. Consequently, if the pressure stabilization level is found corresponding to the dimensionless pressure level of 0.5, the constant coefficient, or pressure match, relating the experimental pressure to the dimensionless pressure can be found.

More specifically, it is known that the late time data associated with the dimensionless pressure derivative curves merge into a straight line, along which straight line the magnitude of the dimensionless pressure is 0.5. This value is based on the fact that at late times infinite acting radial flow dominates and defines the fluid flow at such times. During infinite acting radial flow, dimensionless pressure is defined by:

$$p_D=0.5[\ln(t_D/C_D)+0.80907+\ln(C_De^{2S})]$$

The derivative of this expression with respect to the natural log of dimensionless time is then:

$$d(p_D)/d[\ln(t_D/C_D)]=0.5.$$

Once the stabilization level has been selected by the user along the pressure derivative curve using the crossing of the horizontal and vertical sight lines, the cursor is activated to cause a horizontal straight line to be provided or drawn on the display screen through the pressure stabilization level on the derivative curve and through the ordinate of the log-log graph. The display of the horizontal straight line is provided by the interactive graphics software which identifies the location of the selected pressure stabilization level and acts to cause the straight line to be drawn or displayed. The graphics software also determines the magnitude of the pressure at that point along the pressure axis which is intersected by the horizontal straight line. This intercept value represents a magnitude of experimental pressure change that corresponds to the dimensionless pressure of 0.5.

More particularly, pressure match is defined by the ratio of dimensionless pressure change to a corresponding experimental pressure change. Since the magnitude of pressure match is constant for a particular diagnostic plot, to determine pressure match for such a diagnostic plot, it is only necessary to know or find one value of dimensionless pressure change and also the value of experimental pressure change that corresponds to this known value. Because the dimensionless pressure of 0.5 is a known value for infinite acting radial flow, it is only necessary to find its corresponding pressure This is accomplished by the software which determines the value of the intercept point. The software then determines the pressure match by dividing 0.5 by the value of the intercept point found by the graphics software. In the case of the embodiment illustrated in FIG. 2, the ordinate intercept pressure magnitude is about 74.0 and the pressure match equals about 0.00676.

Figure 3:
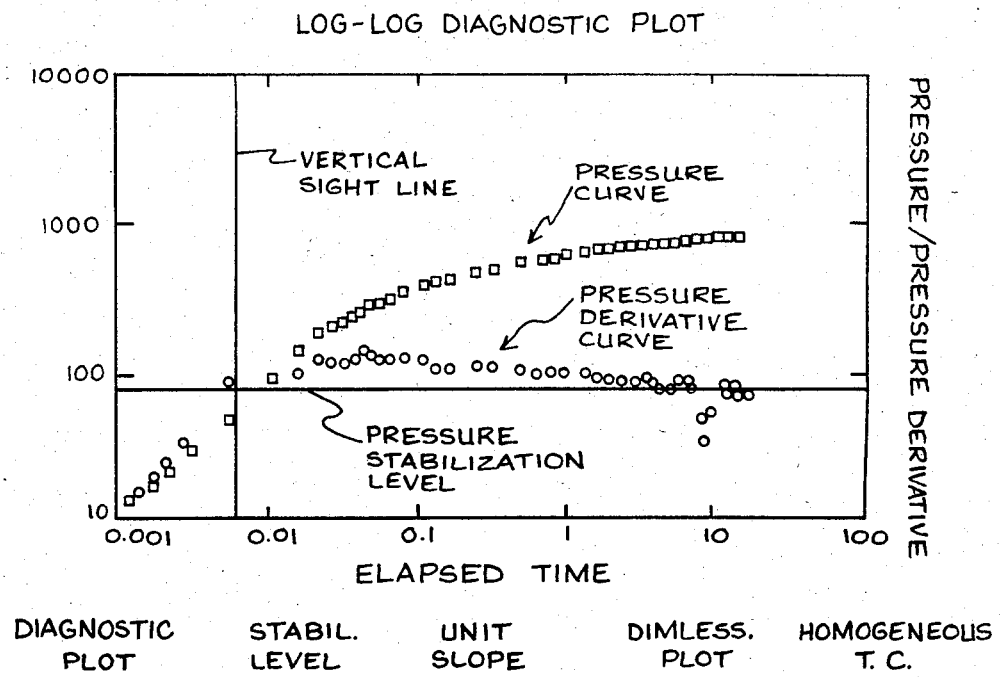
FIG. 3 illustrates a graph of the pressure and pressure derivative curves just prior to the drawing of a unit slope straight line indicating the portion of the pressure curve during which wellbore storage effects dominate.

To determine the magnitude of the time match defined by the ratio of dimensionless time to the experimental or dimensioned time, the user again employs the key words provided on the display screen and, in particular, the key identified as "Unit Slope", unit slope being defined as one log cycle in the pressure change direction being equal to one log cycle in the elapsed time direction. With reference to FIG. 3, the user employs the cursor to enable the Unit Slope procedure or routine. Upon activation, the horizontal and vertical sight lines are once again made available and displayed on the display screen to be moved by the user by means of the cursor. The user causes movement of the sight lines to a point along the pressure curve at which the user determines pure wellbore storage flow dominates. Predominating wellbore storage flow always occurs at early times during build-up or drawdown. The user selects the point through which a unit slope straight line is to be drawn or displayed using the software. The use of the unit slope straight line is based on the fact that, during pure wellbore storage flow, dimensionless pressure equals dimensionless time, i.e.:

$$p_D = t_D / C_D$$

and the derivative of this expression with respect to dimensionless time is defined as:

$$d(p_D)/d(t_D/C_D = 1.$$

Figure 4:
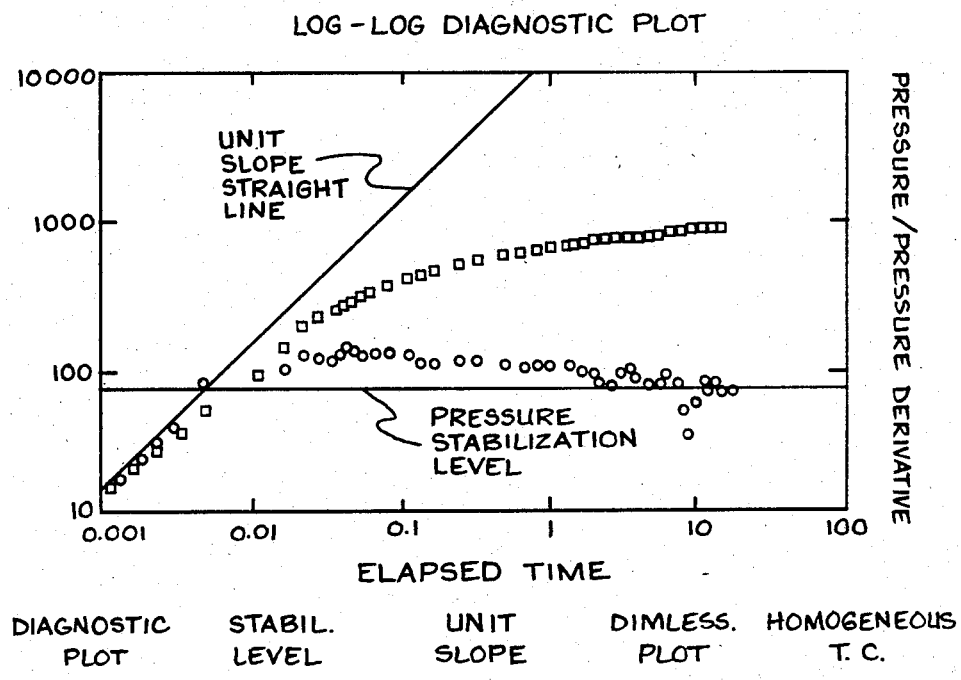
FIG. 4 illustrates a unit slope straight line drawn along that portion of the pressure curve during which wellbore storage effects dominate.

Using this known fact that the pressure curve has a unit slope during pure wellbore storage flow, together with the fact that the dimensionless pressure derivative curve has a value of 0.5 during infinite acting radial flow, the intercept of the pressure stabilization level and the unit slope straight line can be used in finding the time match. That is, the dimensionless time corresponds to a value of 0.5 since the unit slope line intersects the dimensionless pressure stabilization level at a value of 0.5 and the experimental or dimensioned time corresponds to the value of the abscissa or time axis at the intersection of the unit slope straight line and the pressure stabilization level. In determining the magnitude of the time along the abscissa for the dimensioned time, the interactive graphics software first provides or draws the unit slope straight line through the point selected by the user employing the cursor. The software is then used to locate the intersection point of the pressure stabilization level and the unit slope straight line. From the intersection point, the software is able to determine the value of the abscissa or dimensioned time corresponding to the intersection point. The algorithm relating dimensionless time with dimensioned time can then be employed to find the time match, i.e. the time match equals the dimensionless time value divided by the dimensioned time value. In the embodiment of FIG. 4, the abscissa of dimensioned time corresponding to the intercept of the unit slope straight line and the pressure stabilization level has a value equal to about 0.00505 and the time match equals 0.5 divided by 0.00505 or about 98.971.

In the case of a well bore having a high conductivity fracture, instead of the unit slope that exists for pure wellbore storage flow, the slope has a value of 0.5. In the case of a finite conductivity fracture, the slope has a value of 0.25.

Figure 5:
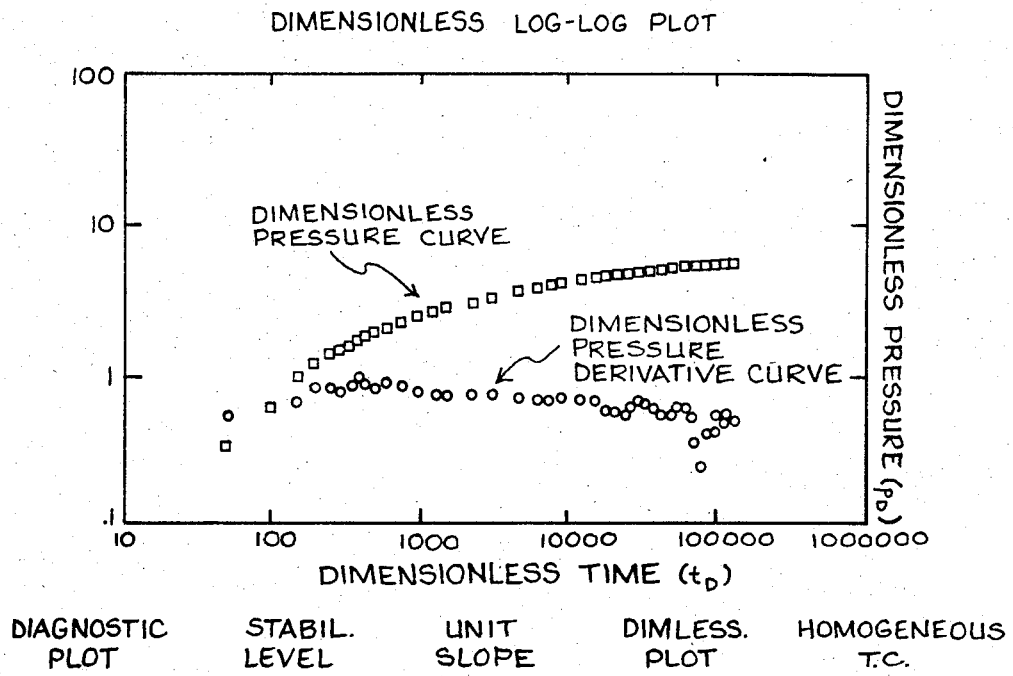
FIG. 5 illustrates experimental dimensionless curves ($p_D$ v. $t_D$ with $C_D=100$) determined using the pressure match and time match.

With the pressure match and time match determined, the pressure and pressure derivative curves can be displayed with dimensionless parameters. In the preferred embodiment, the user once again employs the cursor and the key words to initiate the display of the dimensionless plots. Using the cursor, the user selects the key identified as "Dimless Plot." The software converts the dimensioned pressure and pressure derivative plots to dimensionless plots utilizing the pressure match and time match values previously determined. The graphics software is then able to plot the pressure and pressure derivative curves in dimensionless parameters, as illustrated in FIG. 5. As can be seen, FIG. 5 illustrates plots of the experimental pressure and pressure derivative data using $p_D$ v. $t_D$.

After the dimensionless pressure and pressure derivative curves are displayed, the user returns to the key words to call up and display the homogeneous type-curves. Using the cursor, the user enables the key identified as "Homogeneous T.C." The software including the graphics software then provides a display of a series of type-curves on the computer terminal display screen along with the dimensionless pressure and pressure derivative curves. One of the type-curves is to be selected as matching or corresponding to the dimensionless pressure curve. Each of the type-curves has a different value of S (skin effect). Each of the values of the skin effect S for the different type-curves was obtained using a determined value for dimensionless wellbore storage ($C_D$). Dimensionless wellbore storage $C_D$ is found using the previously obtained values of pressure match and time match, together with other known or determined parameters. In the case of the FIG. 6 type-curves, $C_D = 100$.

Figure 6:
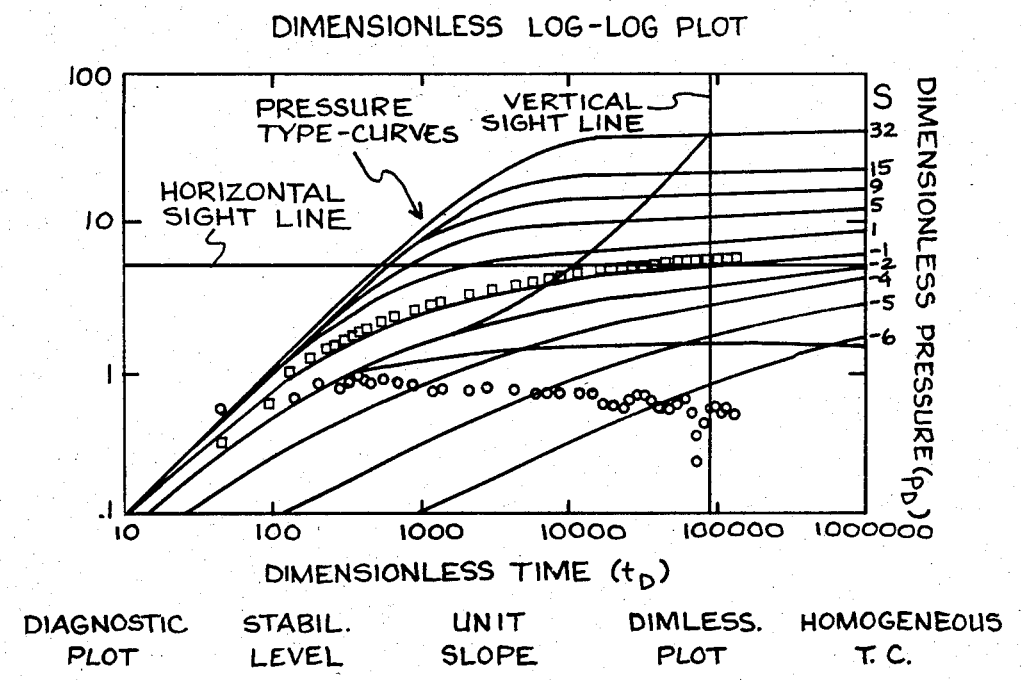
FIG. 6 illustrates finding the interpretation model using the experimental dimensionless pressure curve and the series of pressure type-curves and also illustrates the start of infinite acting semilog radial flow.

To select the type-curve that best corresponds with the dimensionless experimental pressure curve, the user employs the cursor and selects a point along the late time dimensionless pressure curve that intersects with one of the type-curves, as illustrated by the positioning of the horizontal and vertical sight lines shown in FIG. 6. From this selection, the magnitude of S is determined. From the obtained value of S, the value of $C_D e^{2S}$ for the interpretation model can be calculated.

In addition to the type-curves and the pressure and pressure derivative curves, FIG. 6 also illustrates a generally V-shaped curve that intersects the type-curves. This curve indicates the start of infinite acting semilog radial flow. It should also be appreciated that although the embodiment just described relates to a selection based on pressure type-curves, the determination or selection of the interpretation model can be based upon pressure derivative type-curves.

After the interpretation model type-curve has been selected, additional software can be employed to verify the selection. With the selection of the type-curve, the user initiates a verification procedure whereby a check is made to determine whether the selected interpretation model is satisfactory. This checking can be accomplished by, for example, the well-known Horner method, or a modified form of this method. Briefly, a Horner type-curve is plotted along with the pressure data in Horner dimensionless form. A comparison is then made in deciding whether a proper and accurate match resulted from the initial selection of one of the type-curves.

In the case in which the user finds that a better match can be made, the foregoing process is repeated whereby different pressure match and/or time match values are determined. The present invention also includes software features that permit the user to adjust or modify the selections made using the cursor during the carrying out of the process. Rather than repeating the entire aforedescribed process, the user may initiate a sequence which permits the values of pressure match and time match to be changed without a new selection of a pressure stabilization level and/or a unit slope straight line. Specifically, through the keyboard, the user calls up a format for changing the values of pressure match and/or time match. The user then inputs a value of pressure match and/or time match that is believed will provide a better interpretation for the pressure data. Once the pressure match and/or time match have been modified, a comparison can then again be made between the dimensionless experimental pressure curve and the series of type-curves. Because of the previously modified pressure and/or time match, it is expected that a better match can be made between one of the series of type-curves and the dimensionless pressure curve. Another different series of steps that can be initiated by the user for providing a better match involves translation of the dimensionless pressure curve relative to the series of type-curves. That is, during the display of the series of type-curves and the experimental pressure and pressure derivative curves, the user can initiate an option whereby the pressure curve is shifted to better match the pressure curve with one of the series of type-curves. Once the shift is completed, the software includes an algorithm for re-calculating the pressure match and the time match based on the new, shifted location of the pressure curve.

As can be appreciated, an important feature of the present invention is the utilization of an interactive graphics software package for determining the type-curve that best matches the experimental pressure curve. There are graphics software packages commercially available that can be used in providing features associated with the present invention. Such a software package is identified as "TEMPLATE" and is made available by Megatek of San Diego, Calif. Another such graphics software package is identified as "DI 3000" and is made available by Precision Visuals Incorporated of Boulder, Colo. However, it should also be understood that the above-described method for determining pressure match and time match need not be conducted using a computer and/or an interactive graphics software package but can also be accomplished in other ways.

Based on the foregoing detailed description, a number of advantages associated with the present inventive method are readily recognized. The inventive method enables the user to find an accurate type-curve selection by determining pressure match and time match without first resorting to the use of type-curves. Because type-curves are not used to find the pressure match and time match, the user need not be concerned about shifting a dimensionless graph relative to a graph having experimental pressure data. Instead the user can rely on the pressure and pressure derivative curves to directly and immediately find the pressure match and time match for converting the dimensioned pressure to dimensionless form. Relatedly, the present invention permits the user to easily adjust or modify any selections that are made during the process for determining pressure match and time match. As a result, the user need not repeat the entire process if it is determined that a better match between the actual data and the type-curves can be made. Lastly, the present inventive method permits the user to more quickly convert to dimensionless parameters and thereby compare the actual data with the dimensionless theoretical curves.

Although the present invention has been described with reference to a particular embodiment, it should be readily understood that variations and modifications can be effected within the spirit and scope of this invention.

What is claimed is:

1. In a process for finding underground formation characteristics, a method for determing pressure match and time match without the use of type-curves, comprising:

displaying a first graph that relates pressure and time;

displaying a second graph relating to the drivative of a pressure function;

selecting a pressure stabilization level using said second graph;

using the pressure stabilization level and a corresponding magnitude of a dimensionless function of pressure to determine pressure match;

obtaining a time magnitude depending upon the pressure stabilization level and a slope associated with a portion of at least one of said first and second graphs; and using said time magnitude and a corresponding magnitude of a dimensionless function of time to determine time match.

2. A method, as claimed in claim 1, wherein:

said corresponding magnitude of said dimensionless pressure function has a value of 0.5 on log-log graph.

3. A method, as claimed in claim 1, wherein:

said corresponding magnitude of said dimensionless time function has a value of 1 on log-log graph.

4. A method, as claimed in claim 1, wherein said step of selecting said pressure stabilization level includes:

using a computer terminal cursor to locate a first selected position on a computer terminal display screen;

enabling the cursor to select said pressure stabilization level associated with said second graph; and displaying a first straight line through said first selected position on the display screen.

5. A method, as claimed in claim 4, wherein said step of obtaining said time magnitude includes:

using said cursor to locate a second selected position on the display screen;

enabling the cursor;

displaying a second straight line; and intersecting said first straight line and said second selected position.

6. A method, as claimed in claim 1, wherein the step of selecting said pressure stabilization level includes:

providing graph axes including an ordinate having magnitudes relating to a function of pressure and an abscissa having magnitudes relating to a function of time; and wherein the step of using the pressure stabilization level includes:

finding the intercept of the ordinate using a first straight line through said selected pressure stabilization level.

7. A method, as claimed in claim 6, wherein the step of obtaining the time magnitude includes:

providing a second straight line having a known slope; and finding the intercept of the said second straight line with said first straight line.

8. A method, as claimed in claim 7, wherein:

said known slope has a value of 1 for wellbore storage.

9. A method, as claimed in claim 7, wherein:

said known slope has a value of 0.5 for a high conductivity fracture.

10. A method, as claimed in claim 7, wherein:

said known slope has a value of 0.25 for a finite conductivity fracture.

11. A method for determining physical parameters of a fluid-producing underground formation traversed by a wellbore comprising:

obtaining pressure and time related data associated with the underground formation;

plotting the pressure related data as a function of the time related data to provide a pressure function curve;

obtaining the derivative of the pressure function curve;

plotting the pressure function derivative curve;

determining at least one of pressure match and time match using the pressure function derivative curve and without using type-curves defined by dimensionless parameters;

plotting at least one of a dimensionless function of pressure curve and a function of pressure derivative curve using at least one of said pressure match and said time match;

providing at least one of the following: a number of type-curves relating to dimensionless pressure and a number of type-curves relating to a derivative of dimensionless pressure;

selecting one of said type-curves corresponding to one of the following: said pressure function curve and said pressure function derivative curve; and using said selected curve to determine physical parameters associated with the underground formation.

12. A method, as claimed in claim 11, wherein the step of determining pressure match includes:

selecting a level on said pressure function derivative curve;

providing a horizontal straight line through said selected level;

finding the position on a first axis at which said straight line intersects said first axis; and determining said pressure match using said intersect.

13. A method, as claimed in claim 12, wherein:

said level corresponds to a dimensionless value of 0.5.

14. A method, as claimed in claim 12, wherein said step of determining time match includes:

selecting a point on at least one of said pressure function and pressure function derivative curves through which a straight line of a known slope is to be provided;

displaying said known slope straight line;

finding the intercept of said known slope straight line and said horizontal straight line; and determining said time match using said intercept.

* * * * *